United States Patent [19]

Musall et al.

[11] 3,947,252

[45] Mar. 30, 1976

[54] ELASTIC SUSPENSION OR SUPPORT FOR A CERAMIC MONOLITHIC CATALYZER BODY

[75] Inventors: Reimar Musall; Wilhelm Wolsing, both of Hannover, Germany

[73] Assignee: Kali-Chemie AG, Hannover, Germany

[22] Filed: Apr. 9, 1973

[21] Appl. No.: 349,477

[30] Foreign Application Priority Data

Apr. 7, 1972 Germany ..... 2216644

[52] U.S. Cl. ..... 23/288 FC; 138/108; 138/112

[51] Int. Cl.[2] ..... B01J 8/00; F01N 3/15

[58] Field of Search ..... 23/288 F, 288 FC; 60/299; 138/37, 108, 112

[56] References Cited

UNITED STATES PATENTS

| | | | |
|---|---|---|---|
| 2,506,293 | 5/1950 | Copeland | 285/299 X |
| 2,850,365 | 9/1958 | Adey et al. | 23/288 FC UX |
| 2,853,368 | 9/1958 | Adey | 23/288 FC UX |
| 3,094,394 | 6/1963 | Innes et al. | 23/288 F |
| 3,197,287 | 7/1965 | Innes et al. | 23/288 F |
| 3,211,534 | 10/1965 | Ridgway | 23/288 F X |
| 3,248,188 | 4/1966 | Chute | 23/288 F UX |
| 3,441,381 | 4/1969 | Keith et al. | 23/288 F |
| 3,441,382 | 4/1969 | Keith et al. | 23/288 F |
| 3,597,165 | 8/1971 | Keith et al. | 23/288 F |
| 3,692,497 | 9/1972 | Keith et al. | 23/288 F |
| 3,785,781 | 1/1974 | Hervert et al. | 23/288 F |
| 3,787,944 | 1/1974 | Mittman | 29/451 X |
| 3,798,006 | 3/1974 | Balluff | 23/288 F |
| 3,801,289 | 4/1974 | Wiley | 23/288 FC |
| 3,841,842 | 10/1974 | Wiley | 23/288 FC |

FOREIGN PATENTS OR APPLICATIONS

| | | | |
|---|---|---|---|
| 791,117 | 7/1968 | Canada | 23/288 FC |

*Primary Examiner*—Barry S. Richman
*Attorney, Agent, or Firm*—Ernest F. Marmorek

[57] ABSTRACT

An apparatus for decontaminating exhaust gases, such as in motor vehicles, a rigid metallic housing, a catalyzer body of the monolithic type placed in the housing which serves simultaneously as the outer wall of an exhaust gas conduit, a pair of annular pockets or chambers formed at the end portions of the housing, a resilient and corrugated or accordion-like compensating device placed in the pockets and a shell or sleeve surrounding the catalyzer body and having conical flange end portions cooperating with the resilient and corrugated compensating device for supporting the catalyzer body and the shell within the housing.

9 Claims, 3 Drawing Figures

ELASTIC SUSPENSION OR SUPPORT FOR A CERAMIC MONOLITHIC CATALYZER BODY

CROSS-REFERENCE TO OTHER APPLICATIONS

Applications of Reimar Musall et al., Ser. No. 347,559 filed on April 13, 1973; Ser. No. 348,414 filed April 9, 1973; Ser. No. 578,712 (Continuation of Ser. No. 376,338); and Ser. No. 376,338 filed July 5, 1973 all of which applications are still pending. An additional application by Reimar Musall et al., Ser. No. 333,714 filed February 20, 1973 has issued as Patent No. 3,891,396, on June 24, 1975.

FIELD OF THE INVENTION

The present invention relates to an elastic support for a ceramic monolithic body which can be used as the catalyzer carrier preferably in devices used in the decontamination of exhaust gases.

BACKGROUND OF THE INVENTION

The use of ceramic catalyzer carriers having a honeycomb structure for the cleaning of exhaust gases, especially for the cleaning of the exhaust gases of automobiles, has been already known. Such honeycomb structures combine two advantages. On one hand they possess a large surface with respect to a unit volume, on the other the flow resistance through them is very small. The difficulty of their use in devices for the decontamination of exhaust gas of automobiles resides in their required elastic suspension. The pushing forces and vibrations which occur during the travelling of the car, place a heavy mechanical requirement on the honeycomb structure so that finally this will lead to a destruction of the catalyzer carrier.

Elastic suspension for such honeycomb structures have been already proposed, such as by U.S. Pat. No. 3,441,382, which describes a catalyzer patron which exists from a ceramic monolithic catalyzer element placed in a metallic housing and in which between the catalyzer and the housing wall a heat insulating mass, such as fire resistant brick, or molten aluminum oxide, etc., is placed. By means of a metallic spring, which can be adjusted, a pressure is applied to the insulating mass so that the catalyzer body is retained fixedly in its position. Such suspension turned out to be, however, not sufficiently elastic. The pressure applied to the body of the catalyzer is too large and is not uniformly distributed in order to be able to prevent an eventual mechanical destruction of the honeycomb structure.

Another device for the catalytic decontamination of the exhaust gases of automobiles has been described in German DAS 1,476,507. In such device the monolithic catalyzer is placed in a cylindrical housing between a pair of annular flanges which are in gas-tight connection with the housing. Into the annular gap between the housing and the catalyzer a resilient wavy member is placed which can be in form of a corrugated or wavy wire mesh which surrounds the catalyzer body very tightly.

The experience of the automobile industry, especially in the case of high revolution four-cycle engines, proves that the wavy-shaped wire mesh inserts cannot withstand the high thermal and mechanical loading even when the wire mesh is made from a high heat resistant steel. The ceramic body which is embedded in the wire mesh begins to wander around within it when the spanning effect of the wire mesh has lost its original tight application. Then due to the subsequent large shaking and oscillating forces the ceramic body will become quickly destroyed.

SUMMARY OF THE INVENTION

It is, therefore, an object of the present invention to provide an improved elastic suspension for a ceramic catalyzer carrier for use in exhaust gas cleaning arrangements in automobiles.

BRIEF DESCRIPTION OF THE DRAWINGS

The invention will become more readily apparent from the following description of preferred embodiments thereof shown in the accompanying drawings, in which.

DESCRIPTION OF THE PREFERRED EMBODIMENTS

Figure 1:
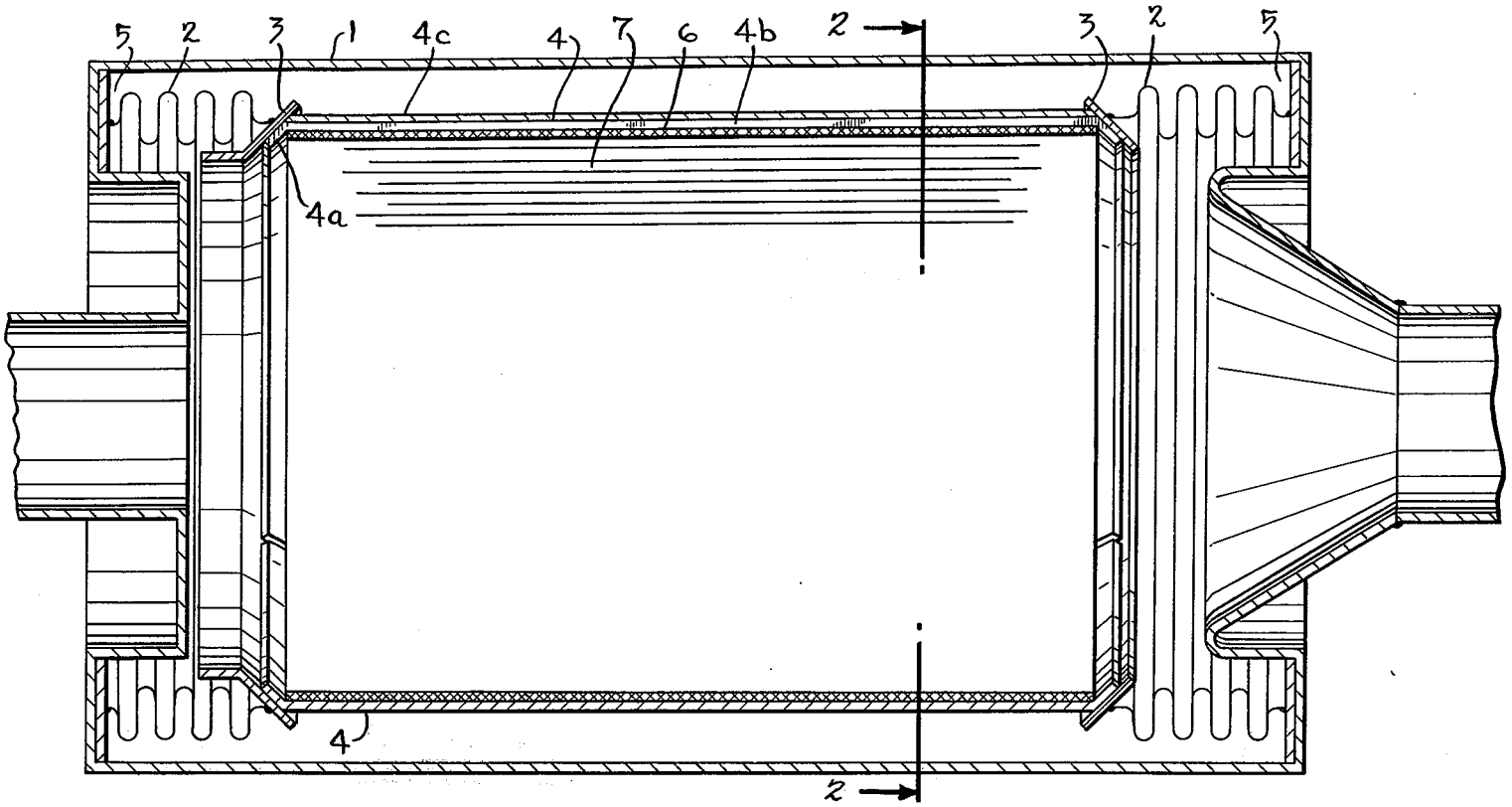
FIG. 1 is longitudinal section through a cleaning arrangement containing the catalyzer body with its elastic suspension according to the present invention.
Figure 3:
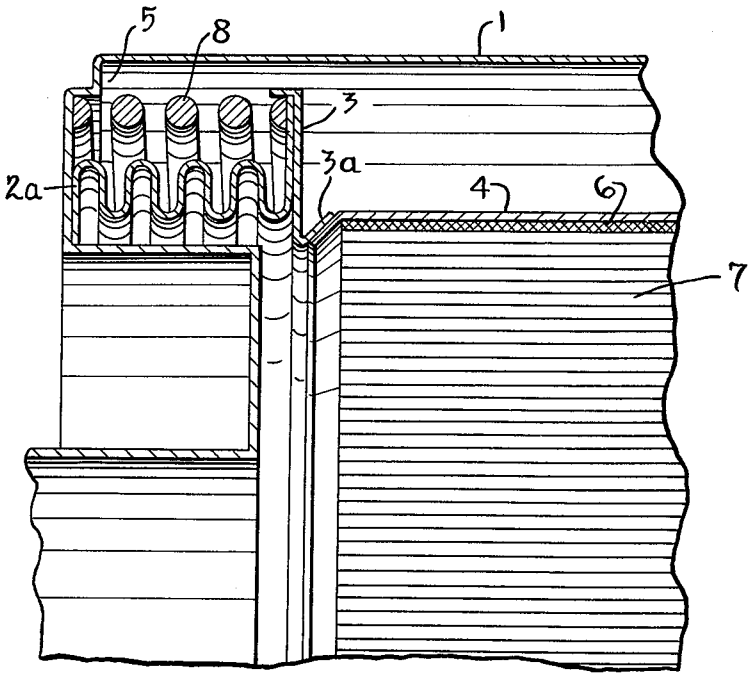
FIG. 3 is a longitudinal section similar to FIG. 1 but of another embodiment according to the present invention.
Figure 2:
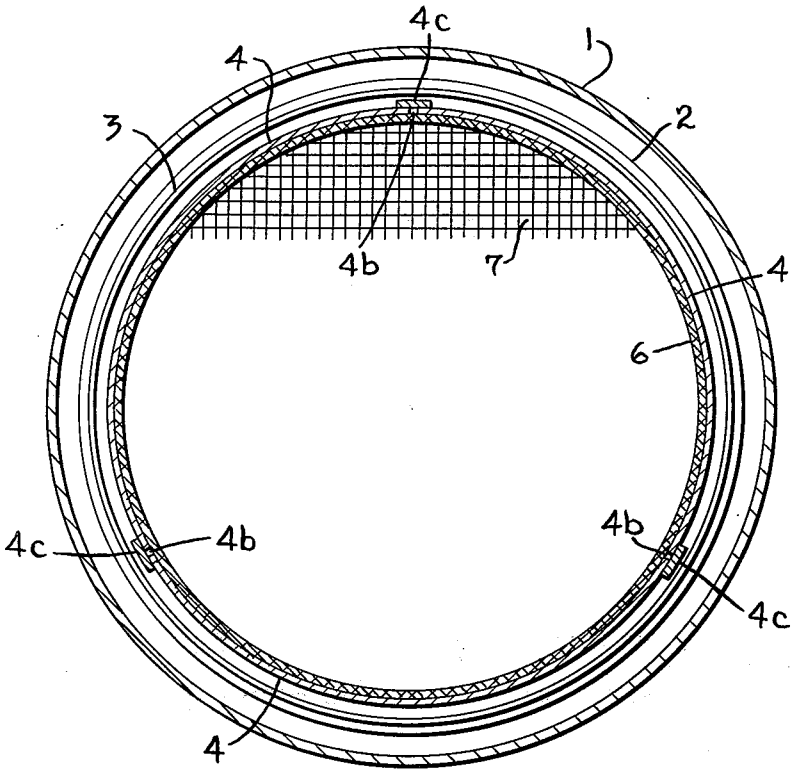
FIG. 2 is a cross-section according to line 2—2 in FIG. 1.

As it can be seen and understood with reference to FIGS. 1–3, the elastic suspension of the ceramic monolithic catalyzer body according to the present invention will not possess the disadvantages associated with the prior art devices described above. The apparatus proposed by the present invention comprises a rigid metal housing 1 which at the same time is the outer wall of an exhaust gas conduit like a motor vehicle, and at both ends of which there are provided annular pockets 5 in which resilient cylindric devices of corrugated material or accordion-type compensators 2 are mounted which are made from a heat-resistant material. Such accordion-type compensators 2 lie at their one side against the end walls of the pockets 5 while on the other side they are fixedly connected with a conical flange 3 or they abut against such conical flange 3. Such conical flanges 3 at each side surround the layer inside two or more circularly arranged sleeve means 4 which in shape correspond to the shape of the catalyzer body 7 placed within them. The sleeves 4 have conical end portions **4*a*, which are shaped to mate with their conical shape of the conically-shaped flanges 3. In the assembled position, flange 3 holds together the several sleeve-like housings 4. The outer sleeves 4 can be made from a single cylindrical body having conical end portions with longitudinal slots 4*b* separating them. The outer sleeves 4 can abut directly onto the body of the catalyzer 7 or onto an intermediate sleeve member 6 which may be made from a heat-resistant sealing material such as a ceramic wool. The compensators 2 in addition to their general function as the elastic suspension for the catalyzer body 7 serve also as a gas-tight seal so that the hot exhaust gases cannot pass through the pockets 5 into the gap between the housing 1 and the body 7. However, through the slot or slots 4*b* between the sleeves 4 which slots 4*b* have the width corresponding to the thickness of the sleeves 4, some gas may flow through. In order to avoid that such a gas quantity could seep into the annular gap between the bodies 1 and 4, the slots 4b are provided with overlapping strips 4*c*. By applying a biasing force on the compensators 2, the sleeves 4 when in place are pressed, by the radial pressure component that results from the interengagement of the conical flange 3 and the conical end portions 4***a*, onto the circumference of the body 7 and retain their support of it during the operation of the vehicle in its original position. In addition, the compensators 2 reduce the high accelerating forces which are applied to the monolithic body 7 caused by the shaking of the entire vehicle.

FIG. 3 illustrates another embodiment of the present invention in which the gas-tight seal is provided by the soft or relatively non-resilient wavy-shaped compensator 2*a*, which, as shown in FIG. 3 with reference to FIG. 1 and FIG. 2, comprises a cylindric device of corrugated material which is fixed in the pockets 5 by means of spiral springs 8 lying substantially in the pocket 5. Thus spiral springs 8 act to supply the additional resiliency necessary to form an essentially gas-tight seal and to suspend the ceramic body 7 against the vibration similarly as described above. The spiral spring 8 and the corrugated wall device 2*a* lie at their one end against the bottom of the respective pocket 5 and at their other end they abut against a conically shaped annular collar 3*a* formed by flange 3. Such conical collar 3*a* surrounds the sleeve or sleeves 4 at its conical end portions similarly as described in connection with FIG. 1. Thus, for the embodiment in FIG. 3 the compensation and support is essentially provided by spring 8 while for the embodiment in FIG. 1, the accordion-type compensator 2, alone, provides the resiliency necessary to form a gas-tight seal.

We wish it to be understood that we do not desire to be limited to the exact details of construction shown and described, for obvious modifications will occur to a person skilled in the art.

Having thus described the invention, what we claim as new and desire to be secured by Letters Patent, is as follows:

1. An apparatus for decontaminating exhaust gases comprising a monolithic catalyst body suitable for removing toxic gases from an exhaust gas passage, including an elastic holder, resiliently suspending said monolithic catalyst body, comprising:

a rigid metallic housing having an inlet opening and an outlet opening and forming the outer wall of said exhaust gas passage;

resilient means operable to provide resilient pressure to a support means and being disposed within said housing near said openings;

a sleeve circumferentially disposed about the monolithic catalyst body and disposed in said housing therewith and including means operable to restrain substantial axial movement of the body relative to the sleeve, and said support means operable to support said sleeve, being disposed near an end of said sleeve and being operably engaged with said resilient means, said support means and said sleeve having matching annular chamfers at adjacent ends thereof interengaging under the pressure of said resilient means whereby said support means supports and centers said sleeve.

2. An apparatus as claimed in claim 1, further comprising a heat resistant sealing material between said sleeve and the monolithic catalyst body.

3. An apparatus as claimed in claim 2, wherein said heat resistant sealing material comprises ceramic wool.

4. An apparatus as claimed in claim 1, further comprising at least one slot defined in said sleeve and extending between the ends thereof whereby a radial pressure component that results from the interengagement of said matching annular chamfers, presses said sleeve onto the circumference of the monolithic catalyst body.

5. An apparatus as claimed in claim 4, further comprising strip means for covering each said slot to restrain the escape of gases from said sleeve.

6. An apparatus as claimed in claim 4, wherein said resilient means comprises a resilient corrugated device operable to form a substantially gas-tight seal between said support means and said housing.

7. An apparatus as claimed in claim 1, wherein said resilient means comprises a resilient corrugated device operable to form a substantially gas-tight seal between said support means and said housing.

8. An apparatus as claimed in claim 7, wherein said resilient means comprises a resilient corrugated wall.

9. An apparatus as claimed in claim 7, wherein said resilient means comprises a flexible corrugated wall and a compression spring disposed around said corrugated wall.

* * * * *